US006704955B1

(12) United States Patent
Jeffries et al.

(10) Patent No.: US 6,704,955 B1
(45) Date of Patent: Mar. 16, 2004

(54) METHOD FOR SECURING BED COVERINGS AND APPARATUS THEREFOR

(76) Inventors: Deidra B. Jeffries, 25408 Via Escovar, Valencia, CA (US) 91355; Sandra B. Brazier, 5445 Lake Lindero Dr., Agoura Hills, CA (US) 91301

( * ) Notice: Subject to any disclaimer, the term of this patent is extended or adjusted under 35 U.S.C. 154(b) by 0 days.

(21) Appl. No.: 10/411,740

(22) Filed: Apr. 11, 2003

Related U.S. Application Data

(63) Continuation-in-part of application No. 10/078,881, filed on Feb. 19, 2002, now Pat. No. 6,557,194.

(51) Int. Cl.[7] ..... A47C 21/02

(52) U.S. Cl. ..... 5/504.1; 5/498; 5/658; 24/72.5

(58) Field of Search ..... 5/494, 496, 498, 5/499, 504.1, 658; 24/72.5

(56) References Cited

U.S. PATENT DOCUMENTS 2,223,412 A * 12/1940 Gartz ..... 24/72.5
2,459,497 A * 1/1949 Calabro ..... 24/72.5
4,276,667 A * 7/1981 Osbourne ..... 5/498
4,662,016 A * 5/1987 Seeman ..... 5/658
4,782,543 A * 11/1988 Hutton et al. ..... 5/658
4,829,617 A * 5/1989 Dameron ..... 5/658
6,557,194 B1 * 5/2003 Jeffries et al. ..... 5/504.1

* cited by examiner

*Primary Examiner*—Robert G. Santos
(74) *Attorney, Agent, or Firm*—Ted Masters

(57) ABSTRACT

A method for attaching a bed covering to a bed includes:

(a) providing a bed having a mattress disposed on top of a box spring, (b) providing a bed covering;

(c) providing a device for attaching the bed covering to the bed, the device including:
an elongated member having first and second ends;
a connector attached to the first end;
an anchor connected to the second end;

(d) positioning the anchor so that it abuts at least one of the side wall of the mattress and the side wall of the box spring;

(e) placing the elongated member between the mattress and the box spring; and, (f) attaching the connector to the bed covering, wherein the connector is sandwiched between the mattress and the box spring.

In another embodiment, the box spring is replaced by a support surface. In another embodiment, the anchor has nubs which horizontally engage both the mattress and the support surface.

6 Claims, 11 Drawing Sheets

Fig. 17
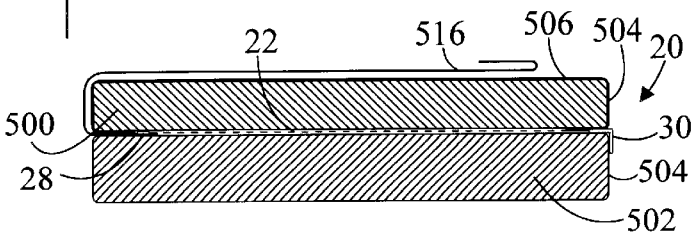
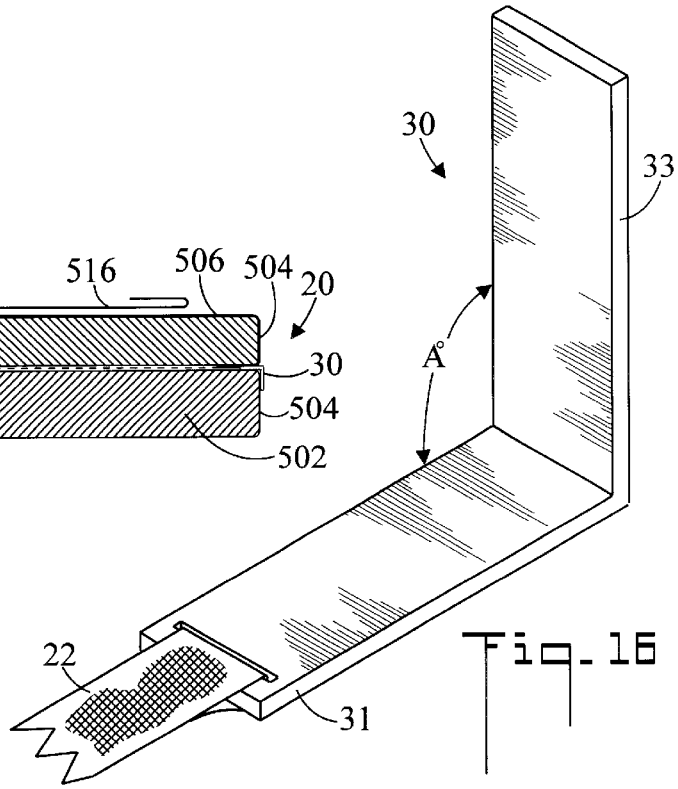
Fig. 16
Fig. 18
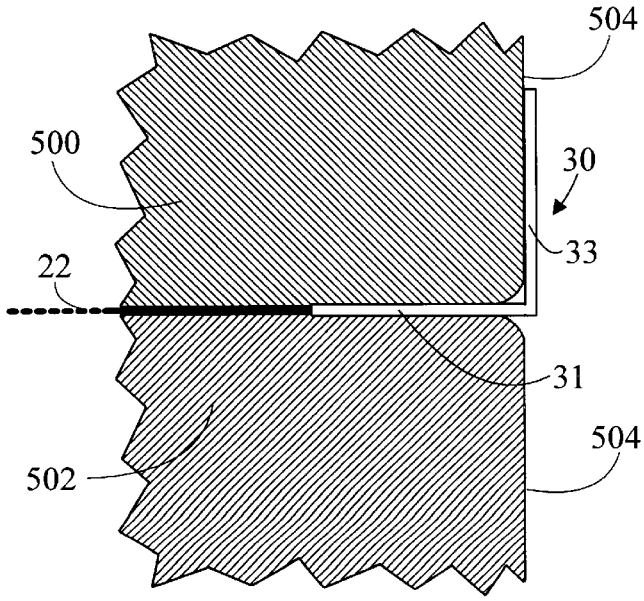

METHOD FOR SECURING BED COVERINGS AND APPARATUS THEREFOR

CROSS REFERENCE TO RELATED APPLICATION

This application is a Continuation-In-Part of application Ser. No. 10/078,881, filed Feb. 19, 2002, now U.S. Pat. No. 6,557,194 which is included herein in its entirety by reference.

TECHNICAL FIELD

The present invention pertains generally to beds and bed coverings, and in particular to a method and apparatus for fastening a bed covering such as a sheet or blanket so that the bed coverings will not pull out from under the mattress.

BACKGROUND ART

Inventions relating to bed coverings and means for securing same are well known in the art. For example, U.S. Pat. No. 2,979,737 depicts a sheet holder for maintaining sheets or other similar articles of bed clothing in a customarily desired position on a bed. The device holds the articles of bed clothing under tension in a desired position.

U.S. Pat. No. 3,350,726 is directed to a mattress retainer having a support. Corner guards are secured adjacent lower ends thereof to corners of the support. A harness is secured to each of the corner guards at a medial portion thereof, and the upper portions of the corner guards serving to restrain the mattress from sliding with respect to the support.

U.S. Pat. No. 4,199,831 pertains to a mattress securing apparatus which utilizes four right angle corner guards disposed at the corners of a mattress resting on a device having a mattress supporting surface therein such as a box spring to prevent lateral displacement of the mattress relative to the supporting surface. A plate, affixed to each corner guard and perpendicular to the right angle leg portions thereof, is located between the supporting surface and the lowermost surface of the mattress. A harness, including an elastic member is located in crisscross fashion, connecting the four corner guards together, urging the corner guards in touching engagement with the corners of the mattress and mattress supporting device. A pair of cords flexibly connect adjacent pairs of corner guards together preventing the corner guards from accidental dislodgement when one corner of the mattress is lifted. A securing plate is utilized to maintain the area of the harness together where the harness elements cross or engage each other near the mid area of the mattress.

U.S. Pat. No. 4,782,543 shows a device for attaching flat bed sheets and other bed covers to a waterbed and for retaining them neatly in a desired position atop the mattress of a waterbed. The device includes a fastener including a slot and stud combination, attached to an elastic connector extending from the fastener to a retainer portion of relatively stiff construction and extending parallel with the bottom of the waterbed, beneath the mattress thereof. The retainer may include openings therethrough, or in another embodiment may include suction cups for gripping the lower surface of the mattress.

U.S. Pat. No. 4,891,856 includes a grasping system for use on contoured sheets to keep sheets tucked and tight under mattress. The system comprises two independent terry elastic straps having a nylon insert clip attached to each end and an adjustable slide on each front end of the straps. Both straps crisscross along bottom surface portion of the mattress.

U.S. Pat. No. 5,033,139 illustrates a device to secure the top sheet of bedding from being accidentally pulled out at the foot of the bed. An elongated piece of plastic material is provided for placement between the mattress and the box springs of a bed, wherein the end of the tucked-in top sheet of the bed is in contact with one side of the elongated piece of material, and the other side of the elongated piece is in contact with the box springs. The top sheet securing device is constructed of materials which have a high coefficient of static friction such that the weight of the mattress pressing down upon the tucked-in top sheet is sufficient to provide compression of the plastic material between the top sheet and lower box springs that the top sheet is held in position against the unintentional or accidental pulling out. The top sheet securing device may be alternately made of a thin sheet of vinyl plastic or a thickness of open or closed cell low density polyurethane foam, or a combination of vinyl plastic and polyurethane foam.

U.S. Pat. No. 5,072,470 discloses a device for holding any number or combination of bedclothes in a fixed position on a bed. The device comprises three component parts all positioned entirely under the uppermost cushioned structure of the bed: a) an anchor member having a plurality of cooperable fastening means disposed generally at peripheral points on it, the fastening means counter poised against one another, b) a plurality of elasticized retaining members having length adjusting mechanism and cooperable fastening means to those on the anchoring member, and c) a plurality of clamps having pivotally connected gripping segments, a closure forcing element and cooperably insertable associated independent coupling elements, said clamps connected to the retaining members. Any number of bedclothes, at any point adjacent to the lower edge of the uppermost cushioned structure, are wrapped around an associated independent coupling element and the associated independent coupling element and bedclothes are then inserted into the clamps. The bedclothes are then tucked under the uppermost cushioned structure of the bed and the elasticized retaining hand is then fastened to the anchoring member the cooperable fastening means. The bedclothes are fastened to the device at opposite sides of the bed and are so held in place by the device through opposing counterpoised force.

U.S. Pat. No. 6,185,766 comprises a bed covering anchor having a pair of adjustable length crossing support straps to allow attachment to the area of the corners of a variety of sizes of bed covering placed on bed mattresses. Elastic straps are engaged at the ends of the crossing straps and have a grasping device at one or both ends of each elastic strap to grasp the covering and provide a retracting force to keep the covering taut on the mattress. One or more lateral support straps may also be attached to the cover to keep the longitudinal edges of the covering taut at the points of attachment.

U.S. Pat. No. 6,295,670 describes a bed covering retention apparatus comprising a planar anchor plate having a proximal portion and a distal portion, an upper surface and a lower surface, a first and a second anchor point at the proximal end of the anchor plate to which first and second elastic bands are removably connected. The first and second elastic bands have a proximal end and distal end and extend from the anchor points along the bottom surface of the anchor plate until each emerges upwardly through respective apertures to the top surface of the anchor plate. The bands further include releasable jaws having an adjustable opening and adjustable tension so that the jaws will clamp securely to sheets and covers of varying thicknesses. The elastic bands are of differing lengths, one being suited to clamping to an innermost bed covering and the other for clamping to coverings above the innermost covering.

DISCLOSURE OF INVENTION

The present invention is directed to a method and device for securing bed coverings, and specifically to a method and device which connects top or bottom bed coverings, such as sheets or blankets, so that the bed coverings will not pull out from under the mattress. The device is installed between the mattress and the box spring, and comprises an elongated member such as a strap, having an anchor at one end, and a connector at the other end.

Prior art inventions require that the strap attach to the sheet or other bed covering at both ends of the strap. With the present invention, once the anchor is in place, an easy, one-time-only event, attachment is required at only at one end to secure the bed covering in place. This permits ease in changing the sheets preventing potential back injuries, saving time and energy.

The present invention is easily secured to and prevents a top or bottom sheet or blanket from becoming untucked. The present invention permits attachment with the same ease as making the bed with the same risk of injury as making the bed conventionally.

The present invention minimizes the prospect of injury because it eliminates the need to remake the bed daily or more often depending on one's bed-making or changing schedule. Adults and those with back pain are assisted by an invention which permits easy bed-making because all that is needed is to pull and smooth the sheets and blankets, not recenter and re-tuck sheets and blankets. Additionally, the present invention permits easy bed-making by children which assists the parents in this housekeeping task, teaches responsibility, and creates self-sufficiency in even the youngest children .

In accordance with a preferred embodiment of the invention, a method for attaching a bed covering to a bed, comprises:

(a) providing a bed having a mattress disposed on top of a box spring, the mattress having a side wall, and the box spring having a side wall disposed adjacent to the side wall of the mattress;

(b) providing a bed covering;

(c) providing a device for attaching the bed covering to the bed, the device including:

an elongated member having a first end and an opposite second end;

a connector attached to the first end;

an anchor connected to the second end;

(d) positioning the anchor so that it abuts at least one of (1) the side wall of the mattress, and (2) the side wall of the box spring;

(e) positioning the elongated member between the mattress and the box spring; and, (f) attaching the connector to the bed covering, so that the connector is sandwiched between the mattress and the box spring.

In accordance with an aspect of the invention, the method further includes:

in step (c), the anchor including a first arm connected to a second arm, the first and second arms defining an angle therebetween; and, in step (d), positioning the anchor so that the first arm is sandwiched between the mattress and the box spring, and the second arm abuts one of (1) the side wall of the mattress, and (2) the side wall of the box spring.

In accordance with another aspect of the invention, the method further includes:

in step (d), positioning the anchor so that it simultaneously abuts the side wall of the mattress and the side wall of the box spring.

In accordance with another aspect of the invention, the method further includes:

in step (c), the connector being a garter connector.

In accordance with another aspect of the invention, the method further includes:

the box spring is replaced with a support surface such as a floor.

In accordance with another aspect of the invention, the anchor has a first side and an opposite second side, nubs being disposed on both the first and second sides. The nubbed anchor is horizontally placed between the mattress and the support surface, wherein the nubs engage both the mattress and the support surface.

Other aspects of the present invention will become apparent from the following detailed description, taken in conjunction with the accompanying drawings, which illustrate, by way of example, the principles of the invention.

BRIEF DESCRIPTION OF DRAWINGS

FIG. 16 is an enlarged perspective view of a second anchor embodiment;

FIG. 17 is a cross sectional view of the device with the second anchor embodiment installed between the mattress and the box spring and attached to a bed covering;

FIG. 18 is an enlarged end elevation view of the second anchor embodiment installed on the bed between the mattress and the box spring;

MODES FOR CARRYING OUT THE INVENTION

Figure 1:
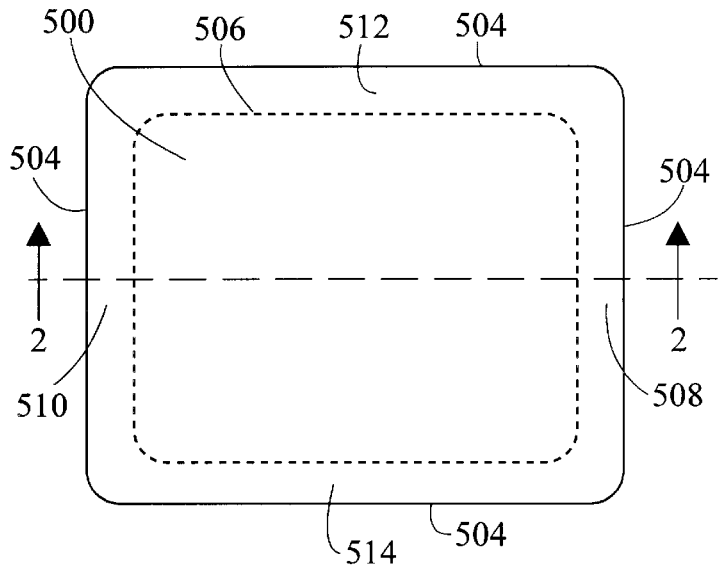
Fig. 1 PRIOR ART
FIG. 1 is a top plan view of a prior art bed comprising a mattress residing on top of a box spring.
Figure 2:
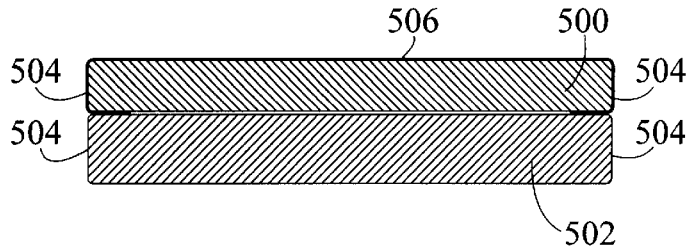
Fig. 2 PRIOR ART
FIG. 2 is cross sectional view along the line 2—2 of FIG. 1.

Referring initially to FIGS. 1 and 2, there are illustrated top plan and cross sectional views respectively of a prior art bed comprising a mattress 500 residing on top of a box spring 502. Mattress 500 and box spring 502 having four sets of adjacent vertical side walls 504. The side walls 504 of mattress 500 are disposed vertically adjacent to the side walls 504 of box spring 502. A bottom bed cover 506, such as a fitted sheet, is fitted around mattress 500 in the conventional manner with the edges of the bottom bed covering 506 pulled around the edges of the mattress 500. The bottom bed covering 506 could also be a flat sheet which is tucked under mattress 500. The bed has a head portion 508 and an opposite foot portion 510, and a right side 512 and an opposite left side 514. The illustrated bed is rectangular, however it may be appreciated that other shapes such as circular are also possible.

Figure 3:
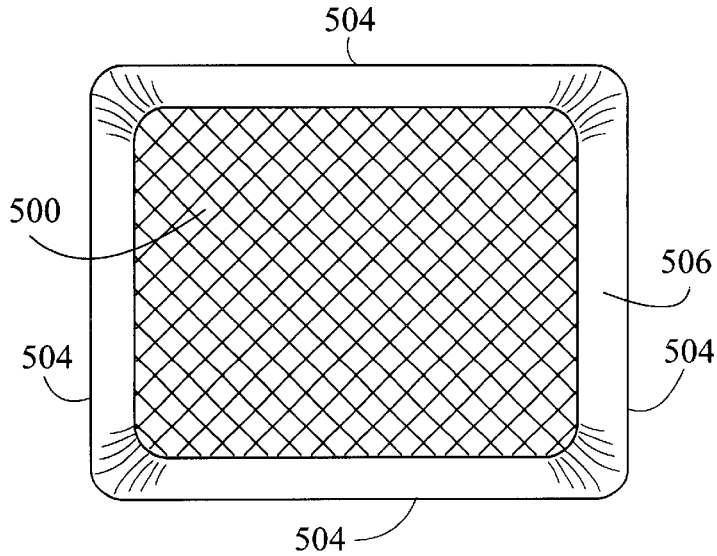
Fig. 3 PRIOR ART
FIG. 3 is a bottom plan view of the mattress.

FIG. 3 is a bottom plan view of mattress 500 showing fitted bottom bed covering 506.

Figure 4:
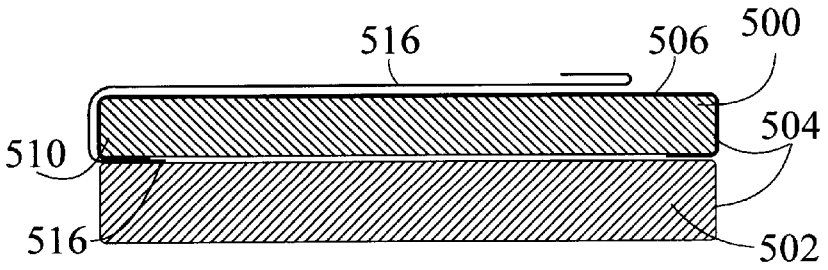
Fig. 4 PRIOR ART
FIG. 4 is a cross sectional view of the mattress and box spring showing both a top and bottom bed covering.

FIG. 4 is a cross sectional view of mattress 500 and box spring 502 showing a top bed covering 516 and bottom bed covering 506. Top bed covering 516 is typically a flat top sheet which is placed over the bottom bed covering 506 and tucked under the edge of mattress 500. Mattress 500 and box spring 502 have side walls 504. When top bed covering 516 is installed on mattress 500, top bed covering 516 has a foot portion or area which resides on the underside of mattress 500 at the foot 510 of the bed. It is noted that, top bed covering 516 could also be a blanket, comforter, or the like. Both top bed covering 516 and bottom bed covering 506 are typically tucked between mattress 500 and box spring 502 at the foot 510 of the bed.

Figure 5:
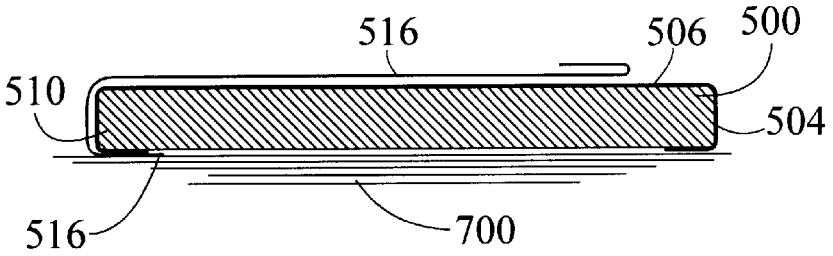
Fig. 5 PRIOR ART
FIG. 5 is a cross sectional view of a prior art mattress residing on top of a support surface.

FIG. 5 is a cross sectional view of mattress 500 residing on top of a support surface 700. In this prior art embodiment, mattress 500 is not placed on top of a box spring 502, but is rather placed directly on a support surface 700 such as the floor. An air mattress 500 placed on the floor 700 to accommodate an overnight guest is representative of this prior art embodiment. As with FIG. 4, top bed covering 516 is typically a flat top sheet which is placed over the bottom bed covering 506 and tucked under the edge of mattress 500. Mattress 500 has a side wall 504. When top bed covering 516 is installed on mattress 500, top bed covering 516 has a foot portion or area which resides on the underside of mattress 500 at the foot 510 of the bed.

Figure 6:
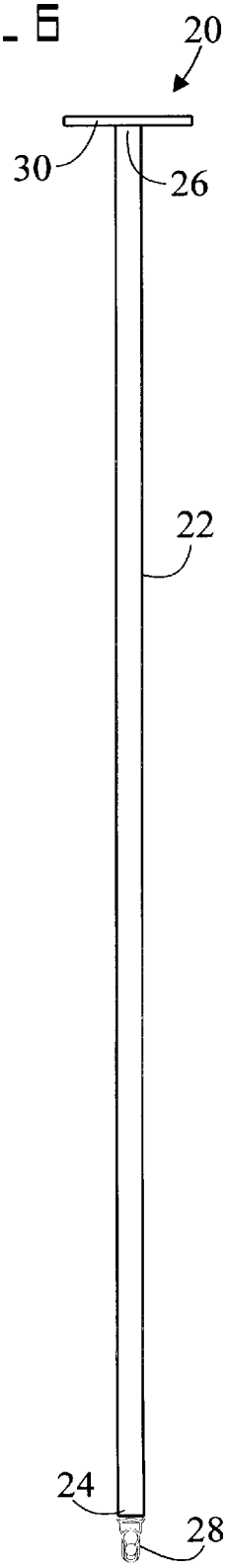
FIG. 6 is an enlarged top plan view of a device for attaching a bed covering to a bed in accordance with the present invention.

FIG. 6 is an enlarged top plan view of a device for attaching a bed covering to a bed in accordance with the present invention, generally designated as 20. Device 20 includes an elongated member 22 having a first end 24 and an opposite second end 26. In the shown preferred embodiment, elongated member 22 is a strap; however, it may be appreciated that elongated member 22 could also be a rope, wire, cable, cord, or the like. In a preferred embodiment, elongated member 22 is flexible. A connector 28 is attached to first end 24, the connector 28 being selectively attachable to a bed covering 506 or 516 (refer to FIG. 4). An anchor 30 is connected to second end 26 of elongated member 22. In the shown embodiment, elongated member 22 is connected to a central portion of anchor 30 (also refer to FIG. 10).

Figure 7:
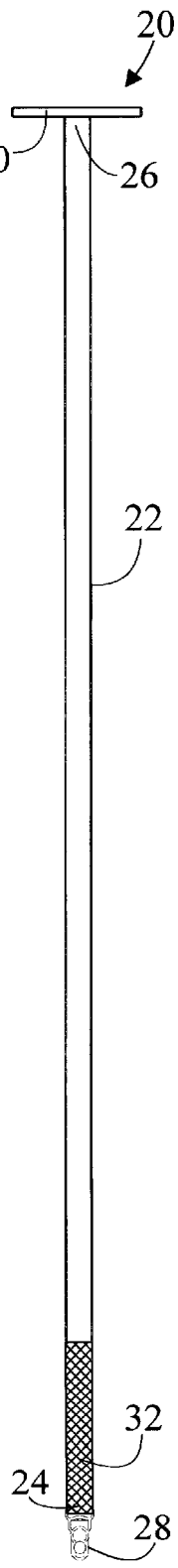
FIG. 7 is an enlarged top plan view of a variation of the device.

FIG. 7 is an enlarged top plan view of a variation of device 20. In this embodiment elongated member 22 is longitudinally stretchable. One manner of achieving this effect is to include an elastic portion 32.

Figure 8:
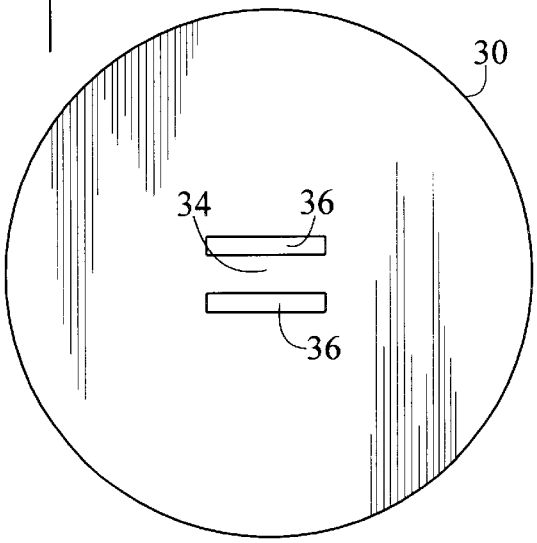
FIG. 8 is an enlarged side elevation view of an anchor.
Figure 9:
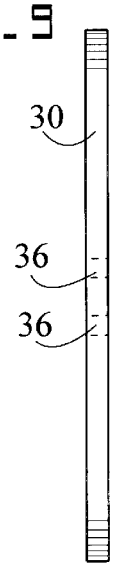
FIG. 9 is an enlarged end elevation view of the anchor.

FIGS. 8 and 9 are enlarged side elevation and end elevation views respectively of anchor 30. In the shown embodiment, anchor 30 is substantially planar, and has a central portion 34 which is connected to second end 26 of elongated member 22. Elongated member 22 passes through slits 36 to effect attachment of anchor 30 (refer also to FIG. 10). The central connection of elongated member 22 to anchor 30 ensures that anchor 30 will catch side walls 504 of both mattress 500 and box spring 502 (refer also to FIG. 13). In the shown embodiment, anchor 30 is circular (disc-shaped); however, anchor 30 could also be oval, rectangular, triangular, x-shaped, or any other shape which can be lodged between mattress 500 and box spring 502 so that it captively abuts the side walls 504 of mattress 500 and box spring 502. In a preferred embodiment, anchor 30 is fabricated from a polymer; however, other ridged or semi-ridged materials could also be utilized.

Figure 10:
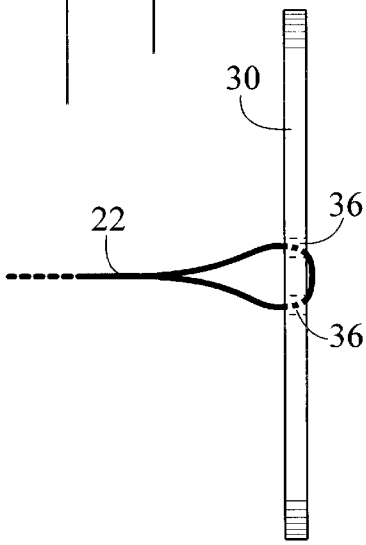
FIG. 10 is an enlarged end elevation view of the anchor connected to an elongated member.

FIG. 10 is an enlarged end elevation view of anchor 30 connected to elongated member 22. Elongated member 22 passes through slits 36 and is then attached to itself such as by stitching or clamping.

Figure 11:
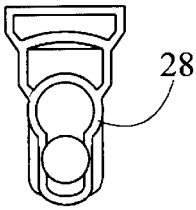
FIG. 11 is an enlarged top plan view of a connector.

FIG. 11 is an enlarged top plan view of connector 28. In the shown preferred embodiment, connector 28 is a garter connector which is well known in the art. A captive flexible tab, typically fabricated from rubber, captures and holds the bed coverings against a metal frame work. This type of connector has the advantage that it will not tear or penetrate the bed coverings. It may be appreciated however, that while the shown garter-type connector is preferred, other connectors such as suspender clamps, pins, Velcro, and the like could also be employed.

Figure 12:
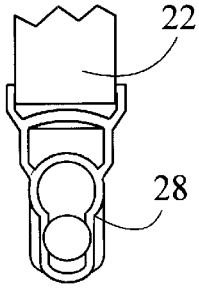
FIG. 12 is an enlarged top plan view of the connector attached to the elongated member.

FIG. 12 is an enlarged top plan view of connector 28 attached to elongated member 22.

Figure 13:
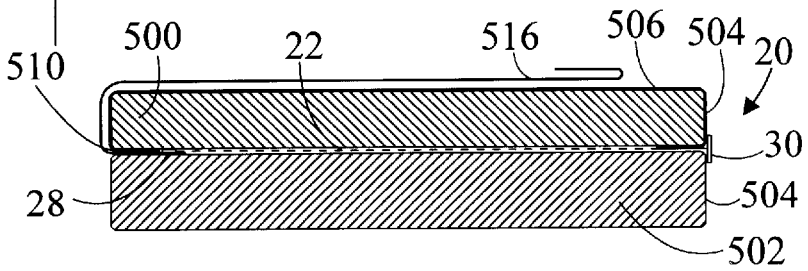
FIG. 13 is a cross sectional view of the device installed between the mattress and the box spring and attached to a bed covering.
Figure 14:
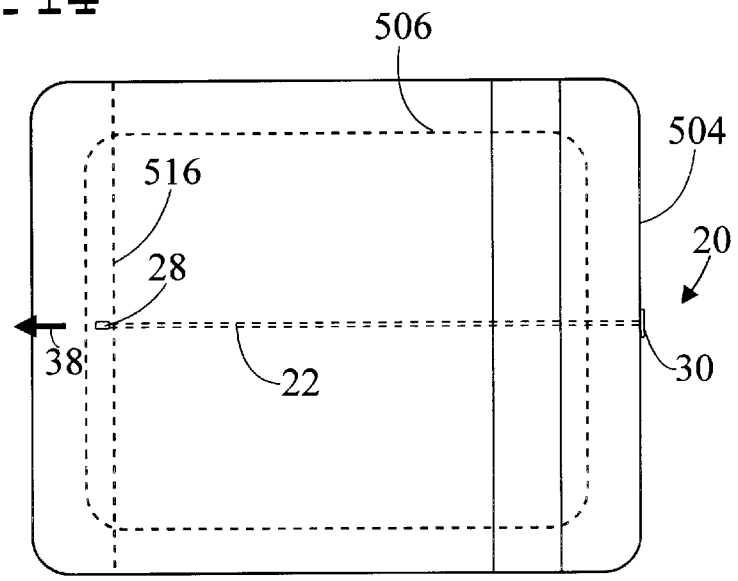
FIG. 14 is a top plan view of the device installed on the bed.

FIGS. 13 and 14 are cross sectional and top plan views respectively of device 20 installed on a bed between mattress 500 and box spring 502 with connector 28 attached to bed covering (top 516 or bottom 506). Elongated member 22 is disposed between mattress 500 and box spring 502 with connector 28 attached, near foot portion 510, to a bed covering, such as top bed covering 516 or bottom bed covering 506. Anchor 30 is positioned so that it simultaneously abuts side walls 504 of both mattress 500 and box spring 502, thereby restricting the bed covering 516 to move a maximum predetermined distance away from the side walls 504. Anchor 30 is captured by side walls 504, and once elongated member 28 is fully extended, bed covering 516 is prevented from moving further in direction 38, and thereby remains tucked under mattress 500. The length of elongated member 22 is selected to extend from side walls 504 across the bed and to the bed covering 506 or 516 on the opposite end of the bed.

Figure 15:
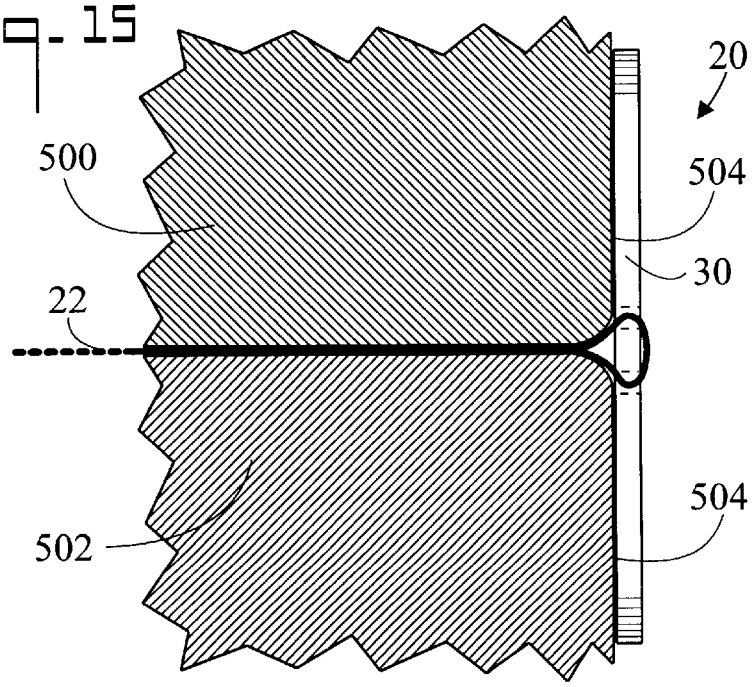
FIG. 15 is an enlarged end elevation view of the anchor installed on the bed.

FIG. 15 is an enlarged end elevation view of device 20 installed on the bed. Anchor 30 resides vertically and abuts and is is captured by side walls 504 of mattress 500 and box spring 502.

FIG. 16 is an enlarged perspective view of a second anchor 30 embodiment. Anchor 30 includes a first arm 31 connected to a second arm 33, the first 31 and second 33 arms defining an angle A therebetween. In a preferred embodiment, angle A is about 90°, wherein anchor 30 has an "L" shape. Elongated member 22 is connected to one of the arms, first arm 31 in the shown embodiment.

FIG. 17 is a cross sectional view of device 20 with the second anchor 30 embodiment installed between mattress 500 and box spring 502 and attached to a bed covering (bottom 506 or top 516). Elongated member 22 may be disposed between mattress 500 and box spring 502 with connector 28 attached to the bed covering wherein the bed covering is tucked between mattress 500 and box spring 502 so that connector 28 is sandwiched between mattress 500 and box spring 502. Anchor 30 may be positioned so that first arm 31 is sandwiched between mattress 500 and box spring 502, and second arm 33 abuts one of (1) the side wall 504 of mattress 500, and (2) the side wall 504 of box spring 502, thereby restricting the bed covering to move a maximum predetermined distance away from the abutting side wall 504. In the shown view, second arm 33 abuts side wall 504 of box spring 502. However, it may be readily appreciated that anchor 30 could be inverted so that second arm 33 abuts side wall 504 of box spring 502 (refer to FIG. 18).

FIG. 18 is an enlarged end elevation view of the second anchor 30 embodiment installed on the bed between mattress 500 and box spring 502. First arm 31 is sandwiched between mattress 500 and box spring 502, and second arm 33 abuts side wall 504 of mattress 500.

In terms of use, a method for attaching a bed covering to a bed includes:

(a) providing a bed having a mattress 500 disposed on top of a box spring 502, mattress 500 having a side wall 504, and box spring 502 having a side wall 504 disposed adjacent to side wall 504 of mattress 500;

(b) providing a bed covering, either a top bed covering 516 or a bottom bed covering 506;

(c) providing a device 20 for attaching the bed covering to a bed, device 20 including:
an elongated member 22 having a first end 24 and an opposite second end 26;
a connector 28 attached to said first end 24;
an anchor 30 connected to second end 26;

(d) positioning anchor 30 so that it abuts at least one of (1) side wall 504 of mattress 500, and (2) side wall 504 of box spring 502;

(e) positioning elongated member 22 between mattress 500 and box spring 502; and, (f) attaching connector 28 to the bed covering, wherein connector 28 is sandwiched between mattress 500 and box spring 502.

The method further including:

in step (c), anchor 30 including a first arm 31 connected to a second arm 33, first 31 and second 33 arms defining an angle A therebetween; and, in step (d), positioning anchor 30 so that first arm 31 is sandwiched between mattress 500 and box spring 502, and second arm 33 abuts one of (1) side wall 504 of mattress 500, and (2) side wall 504 of box spring 502.

The method further including:

in step (c), angle A being about 90°.

The method further including:

in step (a), the bed having a head portion 508 and a foot portion 510;

in step (d), positioning anchor 30 so that it abuts at least one of the side walls 504 (mattress 500 or box spring 502) of head portion 508 of the bed;

in step (f), attaching connector 28 to the bed covering at foot portion 510 of the bed.

The method further including:

in step (d), positioning anchor 30 so that it simultaneously abuts side wall 504 of mattress 500 and side wall 504 of box spring 502.

The method further including:

in step (c), connector 28 being a garter connector.

Figure 19:
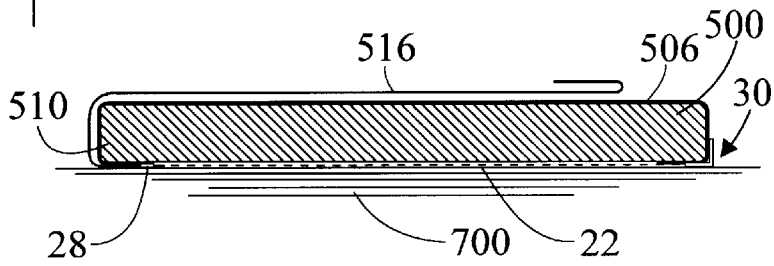
FIG. 19 is a cross sectional view of the device with the second anchor embodiment installed between a mattress and a support surface and attached to a bed covering.
Figure 20:
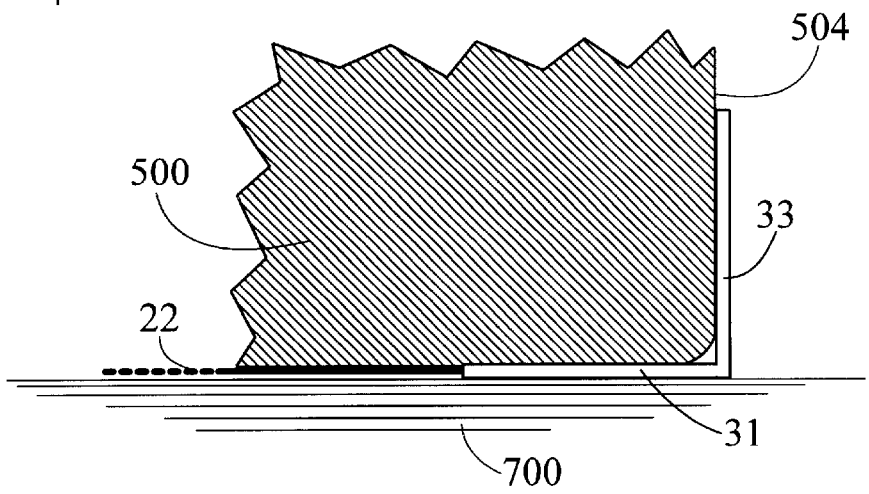
FIG. 20 is an enlarged end elevation view of the second anchor embodiment installed on the bed between the mattress and the support surface.

FIG. 19 is a cross sectional view of device 20 with the second anchor 30 embodiment installed between a mattress 500 and a support surface 700 and attached to a bed covering by connector 28. In this embodiment, mattress 500 (conventional or air) is disposed directly upon the floor or other support surface 700, rather than being on top of a box spring 502. Elongated member 22 may be disposed between mattress 500 and support surface 700 with connector 28 attached to the bed covering, wherein connector 28 is sandwiched between mattress 500 and support surface 700. Anchor 30 may be positioned so that anchor 30 simultaneously abuts side wall 504 of mattress 500 and support surface 700, thereby restricting the bed covering to move a maximum predetermined distance away from side wall 504. Referring also to FIG. 20, in the shown embodiment, first arm 31 abuts support surface 700 and is sandwiched between mattress 500 and support surface 700, and second arm 33 abuts side wall 504 of mattress 500.

FIG. 20 is an enlarged end elevation view of second anchor 30 embodiment installed on the bed between mattress 500 and support surface 700.

Figure 21:
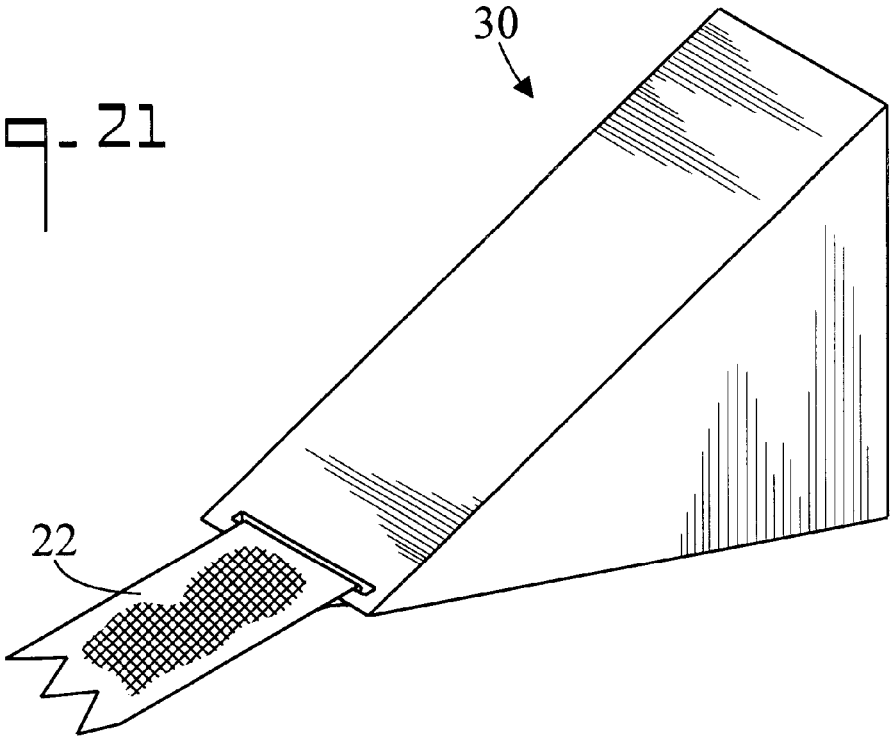
FIG. 21 is an enlarged perspective view of a third anchor embodiment.
Figure 22:
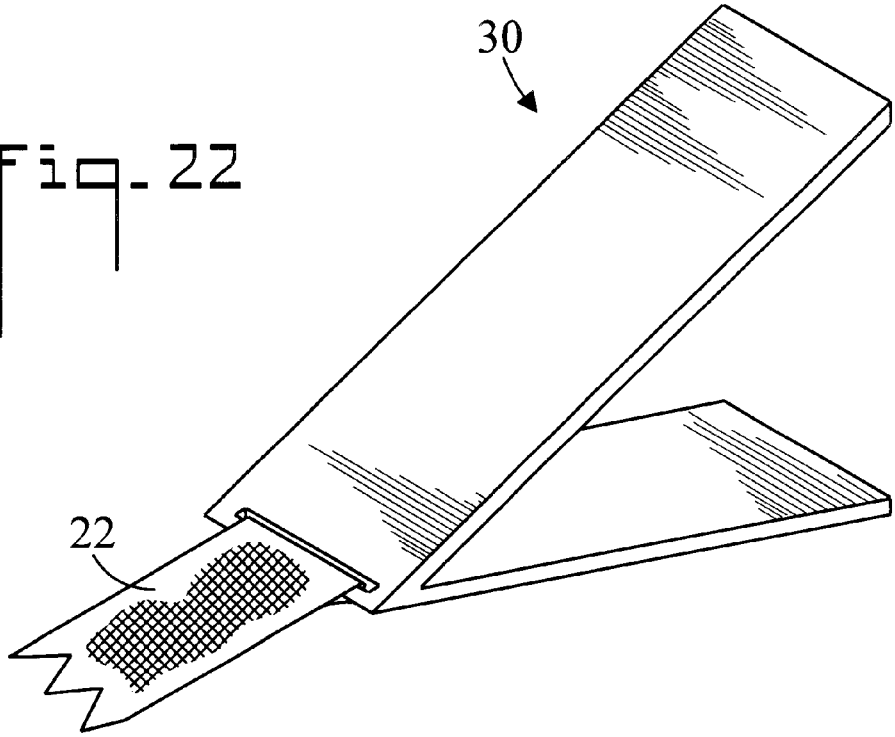
FIG. 22 is an enlarged perspective view of a fourth anchor embodiment.
Figure 23:
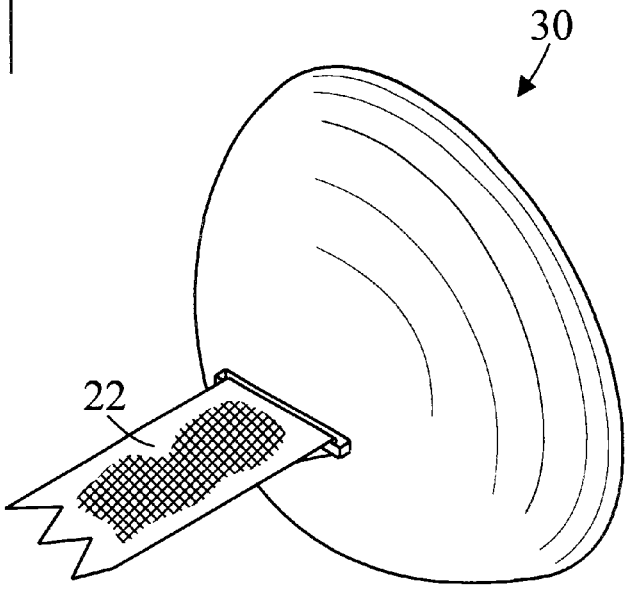
FIG. 23 is an enlarged perspective view of a fifth anchor embodiment.

FIGS. 21–23 are enlarged perspective views of third (wedge shaped), fourth "V" shaped, and fifth (hemisphere shaped) anchor 30 embodiments respectively. As in FIGS. 19 and 20, these anchor 30 embodiments are intended to be used with a mattress 500 residing on a support surface 700, wherein anchor 30 may be positioned so that anchor 30 simultaneously abuts the side wall 504 of mattress 504 and support surface 700, thereby restricting the bed covering to move a maximum predetermined distance away from side wall 504. That is, anchor 30 wedges between mattress 500 and support surface 700 to hold the bed covering in place (refer also to FIG. 24).

Figure 24:
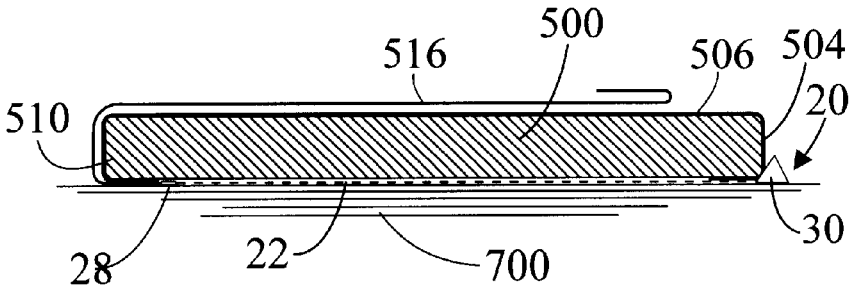
FIG. 24 is a cross sectional view of the device with the third anchor embodiment installed between a mattress and a support surface and attached to a top bed covering.

FIG. 24 is a cross sectional view of device 20 with the third anchor 30 embodiment installed between mattress 500 and a support surface 700 and attached to a bed covering. The fourth and fifth anchor 30 embodiments would be similarly installed.

In terms of use, a method for attaching a bed covering to a bed includes:

(a) providing a bed having a mattress 500 disposed on top of a support surface 700, mattress 500 having a side wall 504;

(b) providing a bed covering (top 516 or bottom 506);

(c) providing a device 20 for attaching the bed covering to the bed, device 20 including:

an elongated member 22 having a first end 24 and an opposite second end 26;

a connector 28 attached to first end 24;

an anchor 30 connected to second end 26;

(d) positioning anchor 30 so that it simultaneous abuts side wall 504 of mattress 500 and support surface 700;

(e) positioning elongated member 22 between mattress 500 and support surface 700; and, (f) attaching connector 28 to bed covering (516 or 506), wherein 28 connector is sandwiched between mattress 500 and support surface 700.

The method further including:

in step (c), anchor 30 including a first arm 31 connected to a second arm 33, first 31 and second 33 arms defining an angle A therebetween; and, in step (d), positioning anchor 30 so that first arm 31 is sandwiched between mattress 500 and support surface 700, and second arm 33 abuts side wall 504 of mattress 500.

The method further including:

in step (c), angle A being about 90°.

The method further including:

in step (c), anchor 30 being one of V shaped, a wedge, and a hemisphere.

The method further including:

in step (a), the bed having a head portion 508 and a foot portion 510;

in step (d), positioning anchor 30 so that it abuts side wall 504 of head portion 508 of the bed;

in step (f), attaching connector 28 to the bed covering at foot portion 510 of the bed.

The method further including:

in step (c), connector 28 being a garter connector.

Figure 25:
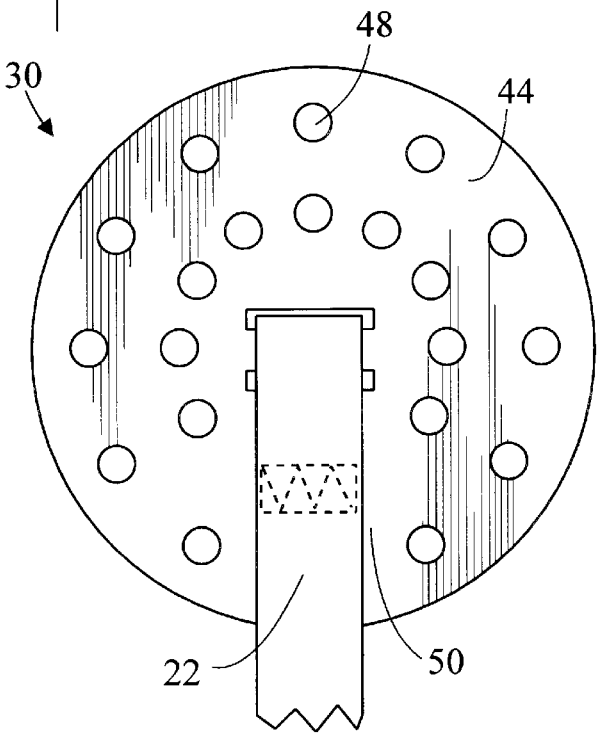
FIG. 25 is an enlarged side elevation view of a sixth anchor embodiment.
Figure 26:
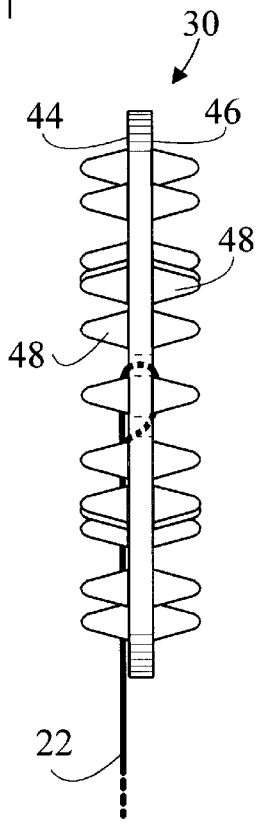
FIG. 26 is an enlarged end elevation view of the sixth anchor embodiment.

FIGS. 25 and 26 are enlarged side elevation and end elevation views respectively of a sixth anchor 30 embodiment. Anchor 30 has a first side 44 and an opposite second side 46. A plurality of nubs 48 are disposed upon both first side 44 and second side 46. In the shown embodiment, nubs 48 comprise, ridged, upstanding, peaks (rounded or pointed). One of side 44 and 46 includes a nub-less swath 50 for carrying elongated member 22. That is, swath 50 is a clear area through which elongated member 22 may pass and lay substantially flat along one nubbed side. This is necessary because in this embodiment elongated member 22 is aligned parallel rather than perpendicular to anchor 30.

Figure 27:
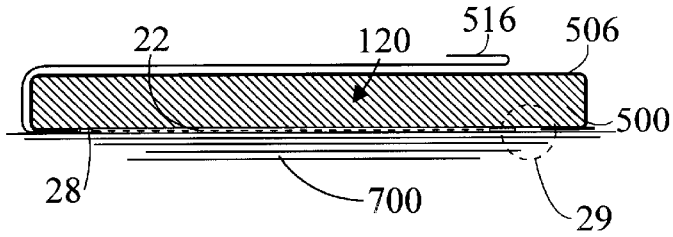
FIG. 27 is a cross sectional view of the sixth anchor embodiment of the device installed on a bed between a mattress and a support surface.
Figure 28:
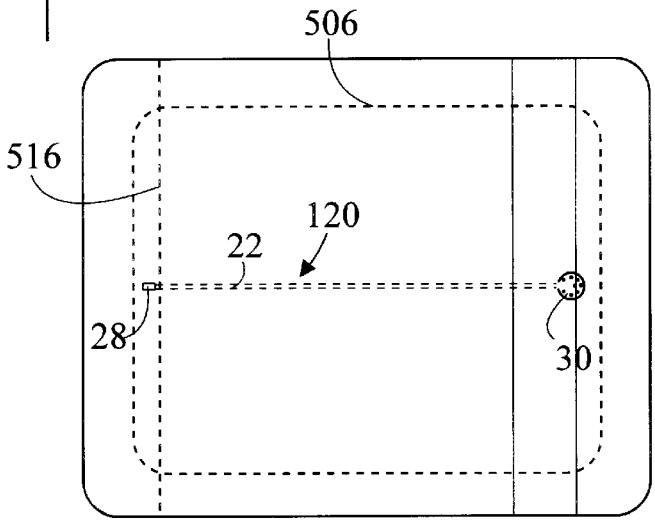
FIG. 28 is a top plan view of the sixth anchor embodiment installed on a bed; and, FIG. 29 is an enlarged cross sectional view of area 29 of FIG. 27.

FIGS. 27 and 28 are cross sectional and top plan views respectively of a second device 120 with the sixth embodiment anchor 30 installed on a bed between mattress 500 and support surface 700. Elongated member may be disposed between mattress 500 and support surface 700 with connector 28 attached to the bed covering wherein connector 28 is sandwiched between mattress 500 and support surface 700. That is, anchor 30 is placed between mattress 500 and support surface 700 so that the weight of mattress 500 (and any bed occupants) causes nubs 48 to engage (dig into) both mattress 500 and support surface 700 thereby holding anchor 30 in place. It is noted that anchor 30 resides in a substantially horizontal position. It is noted that nubs 48 do not adversely affect or change mattress 500 or support surface 700.

Figure 29:
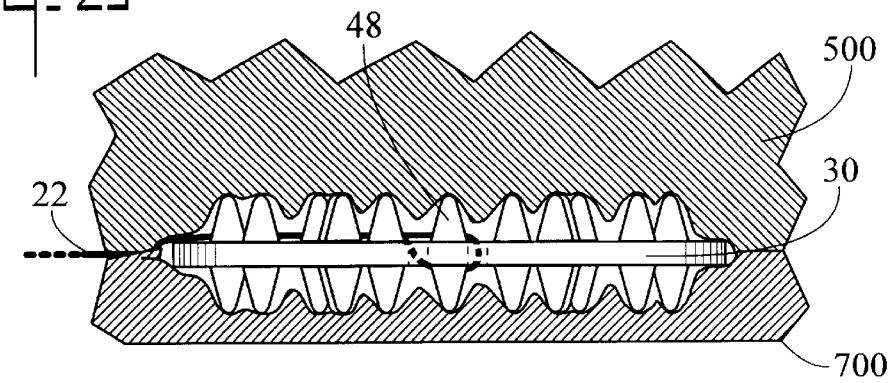

FIG. 29 is an enlarged cross sectional view of area 29 of FIG. 27, showing anchor 30 installed in a horizontal position between mattress 500 and box spring 502. It is noted, that in this embodiment, anchor 30 does not abut the side walls of mattress 500. It is further noted that nubs 48 dig into both mattress 500 and support surface 700. This embodiment of device 120 is particularly useful when support surface 700 is a carpet, but equally effective if support surface 700 is hard such as wood, tile, etc.

A method for attaching a bed covering to a bed includes:

(a) providing a bed having a mattress 500 disposed on top of a support surface 700;

(b) providing a bed covering;

(c) providing a device 120 for attaching the bed covering to the bed, device 120 including:

an elongated member 22 having a first end 24 and an opposite second end 26;

a connector 28 attached to first end 24;

an anchor 30 connected to second end 26, anchor 30 having a first side 44 and an opposite second side 46, and a plurality of nubs 48 disposed upon both first side 44 and second side 46;

(d) positioning anchor 30 between mattress 500 and support surface 700 so that nubs 48 engage both mattress 500 and support surface 700;

(e) positioning elongated member 22 between mattress 500 and support surface 700; and, (f) attaching connector 28 to the bed covering, wherein connector 28 is sandwiched between mattress 500 and support surface 700.

The method further including:

in step (c), anchor 30 including a nub-less swath 50 for carrying elongated member 22.

The method further including:

in step (c), connector 28 being a garter connector.

The method further including:

in step (a), support surface 700 including a carpet or hard floor surface; and, in step (d), nubs 48 digging into both mattress 500 and carpet or hard floor surface.

The preferred embodiments of the invention described herein are exemplary and numerous modifications, variations, and rearrangements can be readily envisioned to achieve an equivalent result, all of which are intended to be embraced within the scope of the appended claims.

We claim:

1. A method for attaching a bed covering to a bed, comprising:

(a) providing a bed having a mattress disposed on top of a support surface;

(b) providing a bed covering;

(c) providing a device for attaching said bed covering to said bed, said device including:

an elongated member having a first end and an opposite second end;

a connector attached to said first end;

an anchor connected to said second end, said anchor having a first side and an opposite second side, and a plurality of nubs disposed upon both said first side and said second side;

(d) positioning said anchor between said mattress and said support surface so that said nubs dig into both said mattress and said support surface;

(e) positioning said elongated member between said mattress and said support surface; and, (f) attaching said connector to said bed covering, wherein said connector is sandwiched between said mattress and said support surface.

2. The method according to claim 1, further including:

in step (c), said anchor including a nub-less swath for carrying said elongated member.

3. The method according to claim 1, further including:

in step (c), said connector being a garter connector.

4. The method according to claim 1, further including:

in step (a), said support surface including a carpet; and, in step (d), said nubs digging into both said mattress and said carpet.

5. A device for attaching a bed covering to a bed, the bed having a mattress disposed on top of a support surface, said device comprising:

an elongated member having a first end and an opposite second end;

a connector attached to said first end, said connector attachable to a bed covering;

an anchor connected to said second end of said elongated member, said anchor having a first side and an opposite second side, and a plurality of nubs disposed upon both said first side and said second side;

wherein said elongated member may be disposed between the mattress and the support surface with said connector attached to the bed covering wherein said connector is sandwiched between the mattress and the support surface; and, wherein said anchor may be positioned so that said anchor is disposed between said mattress and said support surface so that said nubs dig into both said mattress and said support surface.

6. A device according to claim 5, further including:

said anchor including a nub-less swath for carrying said elongated member.

* * * * *